US007717155B2

(12) United States Patent
Mullet

(10) Patent No.: US 7,717,155 B2
(45) Date of Patent: May 18, 2010

(54) PIVOTING BARRIER OPERATOR SYSTEM WITH INTEGRAL CABLE STORAGE DRUM AND TRANSFER ASSEMBLY

(75) Inventor: Willis J. Mullet, Gulf Breeze, FL (US)

(73) Assignee: HomeRun Holdings Corp., North Canton, OH (US)

( * ) Notice: Subject to any disclaimer, the term of this patent is extended or adjusted under 35 U.S.C. 154(b) by 561 days.

(21) Appl. No.: 11/375,837

(22) Filed: Mar. 14, 2006

(65) Prior Publication Data

US 2007/0215292 A1 Sep. 20, 2007

(51) Int. Cl.
*E05F 15/08* (2006.01)

(52) U.S. Cl. ..... 160/188; 160/193; 49/199

(58) Field of Classification Search ..... 160/188, 160/201, 191, 192, 193; 242/244; 254/344; 49/197, 199, 200
See application file for complete search history.

(56) References Cited

U.S. PATENT DOCUMENTS

| | | | | | |
|---|---|---|---|---|---|
| 2,314,015 | A | | 3/1943 | Parsons | 16/198 |
| 3,051,014 | A | | 8/1962 | Houk | |
| 3,695,332 | A | | 10/1972 | Bahnsen | 160/188 |
| 4,175,727 | A | | 11/1979 | Clarke | 254/173 R |
| 4,215,850 | A | | 8/1980 | Haase et al. | 254/350 |
| 4,234,833 | A | | 11/1980 | Barrett | 318/282 |
| 4,338,553 | A | | 7/1982 | Scott, Jr. | 318/266 |
| 4,355,274 | A | | 10/1982 | Bourbeau | 318/812 |
| 4,456,227 | A | | 6/1984 | Notenboom | 254/350 |
| 4,472,910 | A | | 9/1984 | Iha | 49/139 |
| 4,560,046 | A | | 12/1985 | Lorello et al. | 192/11 |
| 4,644,813 | A | * | 2/1987 | Whitehouse et al. | 74/431 |
| 4,706,727 | A | * | 11/1987 | Leivenzon et al. | 160/188 |
| 4,817,927 | A | | 4/1989 | Martin | 267/155 |
| 4,940,357 | A | | 7/1990 | Davis | 403/344 |
| 5,048,653 | A | | 9/1991 | Fellows | 192/67 |
| 5,222,327 | A | | 6/1993 | Fellows et al. | 49/139 |
| 5,222,403 | A | | 6/1993 | Angelini et al. | 74/892.1 |
| 5,278,480 | A | | 1/1994 | Murray | 318/626 |
| 5,335,883 | A | * | 8/1994 | Mawer | 242/602.1 |
| 5,557,887 | A | | 9/1996 | Fellows et al. | 49/28 |
| 5,581,939 | A | | 12/1996 | Regan et al. | 49/139 |
| 5,632,063 | A | | 5/1997 | Carper et al. | 16/198 |
| 5,698,073 | A | | 12/1997 | Vincenzi | 160/188 |
| 5,929,580 | A | | 7/1999 | Mullet et al. | 318/466 |
| 5,931,212 | A | | 8/1999 | Mullet et al. | 160/188 |
| 6,078,263 | A | | 6/2000 | Galloway, Jr. | 340/679 |
| 6,097,166 | A | | 8/2000 | Fitzgibbon et al. | 318/471 |
| 6,118,243 | A | | 9/2000 | Reed et al. | 318/468 |

(Continued)

FOREIGN PATENT DOCUMENTS

| | | |
|---|---|---|
| DE | 20 2004 014 167 | 9/2003 |

(Continued)

*Primary Examiner*—Blair M. Johnson
(74) *Attorney, Agent, or Firm*—Renner Kenner Greive Bobak Taylor & Weber

(57) ABSTRACT

An operator system for moving a barrier between limit positions, comprising an operator motor assembly mounted proximate to the barrier, at least a portion of said operator motor assembly movable depending upon an operating condition thereof; a counterbalance system adapted to be connected to the barrier, said counterbalance system coupled to said operator motor assembly to move the barrier; and an integral cable storage drum and transfer assembly connecting said operator motor assembly to said counterbalance system.

5 Claims, 6 Drawing Sheets

U.S. PATENT DOCUMENTS

| | | | | |
|---|---|---|---|---|
| 6,133,703 | A | 10/2000 | Fitzgibbon et al. | 318/445 |
| 6,134,835 | A * | 10/2000 | Krupke et al. | 49/200 |
| 6,164,014 | A | 12/2000 | McDowell et al. | 49/200 |
| 6,230,785 | B1 * | 5/2001 | Tokuyama et al. | 160/310 |
| 6,230,864 | B1 | 5/2001 | Cline | 192/69.9 |
| 6,253,824 | B1 | 7/2001 | Mullet et al. | 160/188 |
| 6,325,134 | B1 | 12/2001 | Mullet | 160/189 |
| 6,326,751 | B1 | 12/2001 | Mullet et al. | 318/434 |
| 6,327,744 | B1 | 12/2001 | Dorma | 16/197 |
| 6,376,832 | B1 | 4/2002 | Smith et al. | 250/231.14 |
| 6,401,792 | B1 * | 6/2002 | Mullet et al. | 160/188 |
| 6,401,793 | B1 | 6/2002 | Martin | 160/191 |
| 6,422,965 | B1 * | 7/2002 | Balli et al. | 475/149 |
| 6,528,961 | B1 | 3/2003 | Fitzgibbon et al. | 318/283 |
| D472,568 | S | 4/2003 | Mullet et al. | D15/199 |
| D473,573 | S | 4/2003 | Mullet et al. | D15/199 |
| 6,561,255 | B1 | 5/2003 | Mullet | 160/188 |
| 6,568,454 | B1 * | 5/2003 | Mullet et al. | 160/188 |
| 6,605,910 | B2 | 8/2003 | Mullet et al. | 318/264 |
| 6,655,817 | B2 | 12/2003 | Devlin et al. | 362/233 |
| 6,742,564 | B2 | 6/2004 | Martin | 160/201 |
| 7,061,197 | B1 * | 6/2006 | Mullet et al. | 318/466 |
| 7,367,160 | B2 * | 5/2008 | Mullet et al. | 49/199 |
| 2004/0006918 | A1 | 1/2004 | Fitzgibbon | 49/28 |
| 2004/0064287 | A1 | 4/2004 | Fitzgibbon | 702/145 |

FOREIGN PATENT DOCUMENTS

| | | | |
|---|---|---|---|
| EP | 0 162 799 | B1 | 9/1989 |
| EP | 0 775 799 | | 11/1996 |
| EP | 0 579 727 | B1 | 8/1997 |
| EP | 0 924 585 | B1 | 6/2001 |
| WO | WO 02/086270 | A2 | 10/2002 |
| WO | WO 03/071365 | A2 | 8/2003 |

* cited by examiner

PIVOTING BARRIER OPERATOR SYSTEM WITH INTEGRAL CABLE STORAGE DRUM AND TRANSFER ASSEMBLY

TECHNICAL FIELD

The present invention relates generally to operators for barriers such as overhead doors. More particularly, the present invention relates to an operator system for moving a sectional or slab type overhead door between open and closed positions. More specifically, the present invention relates to a pivoting barrier operator system and a counterbalance system, wherein the counterbalance system supports a drive tube that carries an integral cable storage drum and transfer assembly that is coupled to a drive gear of the operator system.

BACKGROUND ART

Motorized devices for opening and closing sectional overhead doors have long been known in the art. These powered door operators were developed in part due to extremely large, heavy commercial doors for industrial buildings, warehouses, and the like where opening and closing of the doors essentially mandates power assistance. Later, homeowners' demands for the convenience and safety of door operators resulted in an extremely large market for powered door operators for residential usage.

The vast majority of motorized operators for residential garage doors employ a trolley-type system that applies force to a section of the door or barrier for powering it between the open and closed positions. Another type of motorized operator is known as a "jack-shaft" operator, which is used virtually exclusively in commercial applications and is so named by virtue of similarities with transmission devices where the power or drive shaft is parallel to the driven shaft, with the transfer of power occurring mechanically, as by gears, belts, or chains between the drive shaft and a driven shaft, normally part of the door counterbalance system, controlling door position. While some efforts have been made to configure hydraulically or pneumatically-driven operators, such efforts have not achieved any substantial extent of commercial acceptance.

The well-known trolley-type door operators are attached to the ceiling and connected directly to a top section of a garage door and for universal application may be powered to operate doors of vastly different size and weight, even with little or no assistance from a counterbalance system for the door. Since the operating force capability of trolley-type operators is normally very high, force adjustments are normally necessary and provided to allow for varying conditions and to allow the operator to be adjusted for reversing force sensitivity, depending on the application. When a garage door and trolley-type operator are initially installed and both adjusted for optimum performance, the overhead door system can perform well as designed. However, as the system ages, additional friction develops in door and operator components due to loss of lubrication at rollers and hinges. Also, the door can absorb moisture and become heavier, and counterbalance springs can lose some of their original torsional force. These and similar factors can significantly alter the operating characteristics seen by the operator, which may produce erratic door operation such as stops and reversals of the door at unprogrammed locations in the operating cycle.

One system that addresses the aforementioned problems is disclosed in U.S. patent application Ser. No. 11/165,138 filed on Jun. 22, 2005, which is incorporated herein by reference. Such a system is referred to as a pivoting and barrier locking operator system. Briefly, such a system includes a motor with appropriate gearing that is linked to a counterbalance system that assists in moving a barrier, such as a sectional door, between defined limit positions. The motor either directly rotates a counterbalance drive tube or imparts rotational forces to a drive assembly which in turn rotates a counterbalance drive tube. Typically, the drive assembly is used when the operator system is installed for use with a pre-existing counterbalance system. In either version of operator system, the drive tube is connected at each end to a cable storage drum. Lift cables are secured at one end to each storage drum and at respective ends to at least a bottom section of the barrier. Accordingly, as the drive tube is rotated, the storage drums pay-out or reel in the respective cable.

With most cable storage drums, whether used in winches or in counterbalance systems for barriers, the drums positioned on shafts are rotatable about the axis of the shaft and are either fixed to the shaft such that the drum and shaft revolves together or the shaft is non-rotatable and serves as support and a bearing surface for the drum. Some prior art has drive gear systems where a drive gear, with input from a torque source, drives the driven gear ring attached or formed into the outer perimeter of the cable storage drum. In these prior art devices the rotation of the cable drum's driven gear is in the opposite direction of the drive gear. Where in most applications this opposite rotation is acceptable, in counterbalancing systems, such as disclosed in the '138 application referenced above, it is not. Known designs that will allow the drive and driven gears to rotate the same direction require an idler gear that is driven by the drive gear and which then drives the driven gear. This arrangement requires additional room and bracketry to mount and contain the idler gear.

DISCLOSURE OF THE INVENTION

Therefore, one aspect of the present invention is to provide a pivoting barrier operator system with integral cable storage drum and transfer assembly.

It is another aspect of the present invention to provide an operator system for moving a barrier between limit positions, comprising an operator motor assembly mounted proximate to the barrier, at least a portion of the operator motor assembly movable depending upon an operating condition thereof; a counterbalance system adapted to be connected to the barrier, the counterbalance system coupled to the operator motor assembly to move the barrier; and an integral cable storage drum and transfer assembly connecting the operator motor assembly to the counterbalance system.

Yet another aspect of the present invention is to provide a cable storage drum and transfer assembly used in a barrier operator system which rotates a counterbalance tube that in turn moves a barrier between limit positions through at least one lifting cable, the assembly comprising a hub attachable to the counterbalance tube; a driven gear extending from the hub and engageable with the barrier operator system; and a cable storage area extending from the hub, the cable storage area attachable to the at least one lifting cable.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
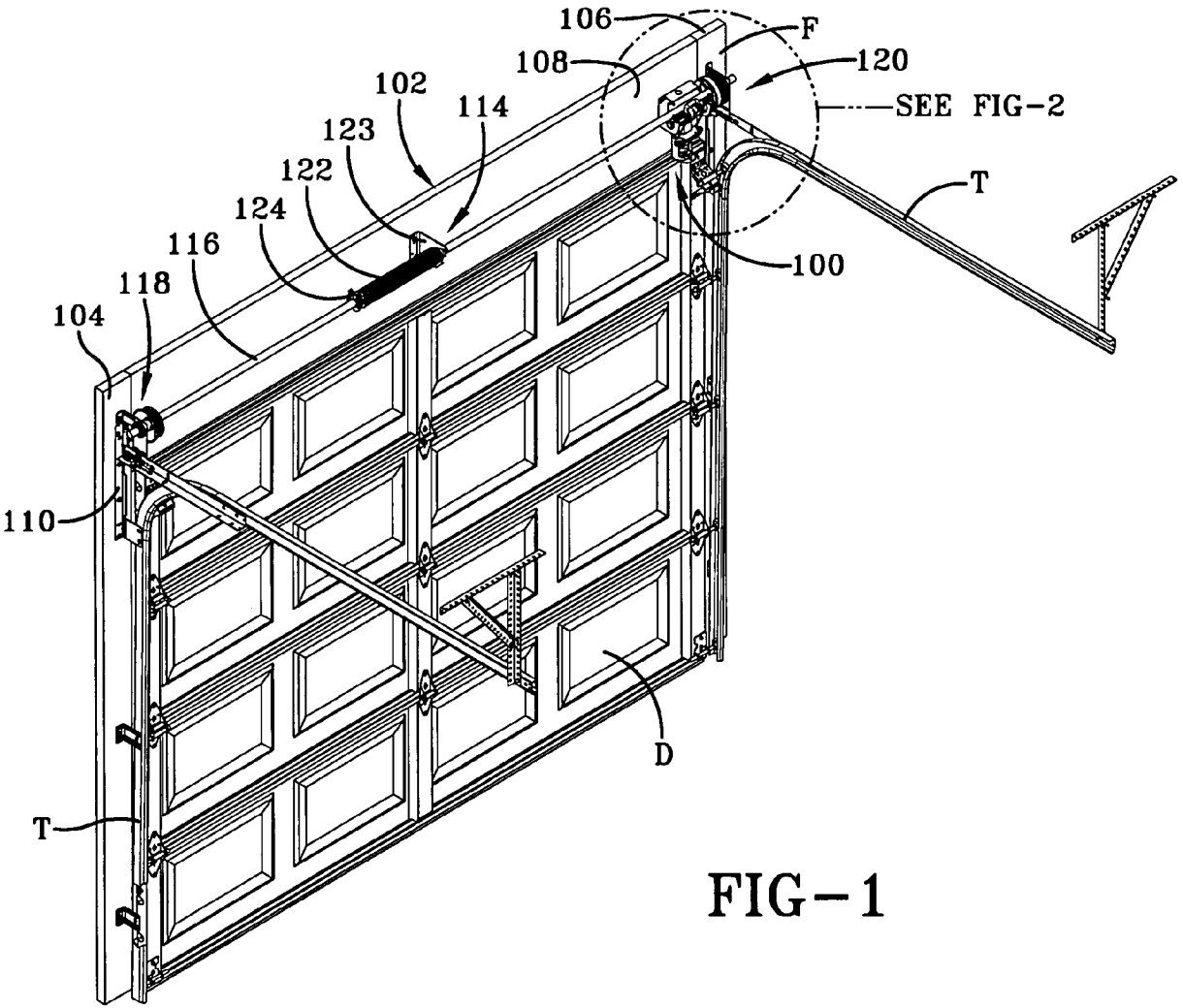
FIG. 1 is a rear perspective view of a sectional overhead garage door installation showing a motorized operator system according to the concepts of the present invention installed in operative relation thereto, with the operator system depicted in an operating position.

A motorized operator system according to the concepts of the present invention is generally indicated by the numeral 100 in FIGS. 1-5. The operator system 100 shown in FIG. 1 is mounted in conjunction with a barrier such as a sectional door D of a type commonly employed in garages for residential housing. However, it will be appreciated that the concepts disclosed in relation to the operator system and its various embodiments can be employed with other barriers such as curtains, awnings, gates and the like. The opening in which the door D is positioned for opening and closing movements relative thereto is defined by a frame generally indicated by the numeral 102, which consists of a pair of spaced jambs 104, 106 which are generally parallel and extend vertically upwardly from the floor (not shown). The jambs 104, 106 are spaced apart and may or may not be joined at their vertical upper extremity by a header or portions of a header 108 to thereby delineate a generally inverted u-shaped frame around the opening of the door D. The jambs and the header are normally constructed of lumber, as is well known to persons skilled in the art, for purposes of reinforcement and facilitating the attachment of elements supporting and controlling door D, including the operator system 100.

Affixed to the jambs 104,106 proximate the upper extremities thereof and the lateral extremities of the header 108 to either side of the door D are flag angles 110 which are secured to the underlying jambs 104,106 respectively. Connected to and extending from the flag angles 110 are respective tracks T which are located on either side of the door D. The tracks provide a guide system for rollers attached to each side of the door as is well known in the art. The tracks T define the travel of the door D in moving upwardly from the closed to open position and downwardly from the open to closed position. The operator system 100 may be electrically interconnected with a peripheral device, such as a light kit, which may contain a power supply, a light, and a radio receiver with antenna. The receiver receives wireless signals—such as radio frequency or otherwise—for remote actuation of the peripheral device in a manner known in the art. The operator system 100 may be controlled by wired or wireless transmitter devices which provide user-functions associated therewith. The peripheral device may also be a network device which generates or transfers wireless signals to lights, locks or other operational peripherals.

Figure 2:
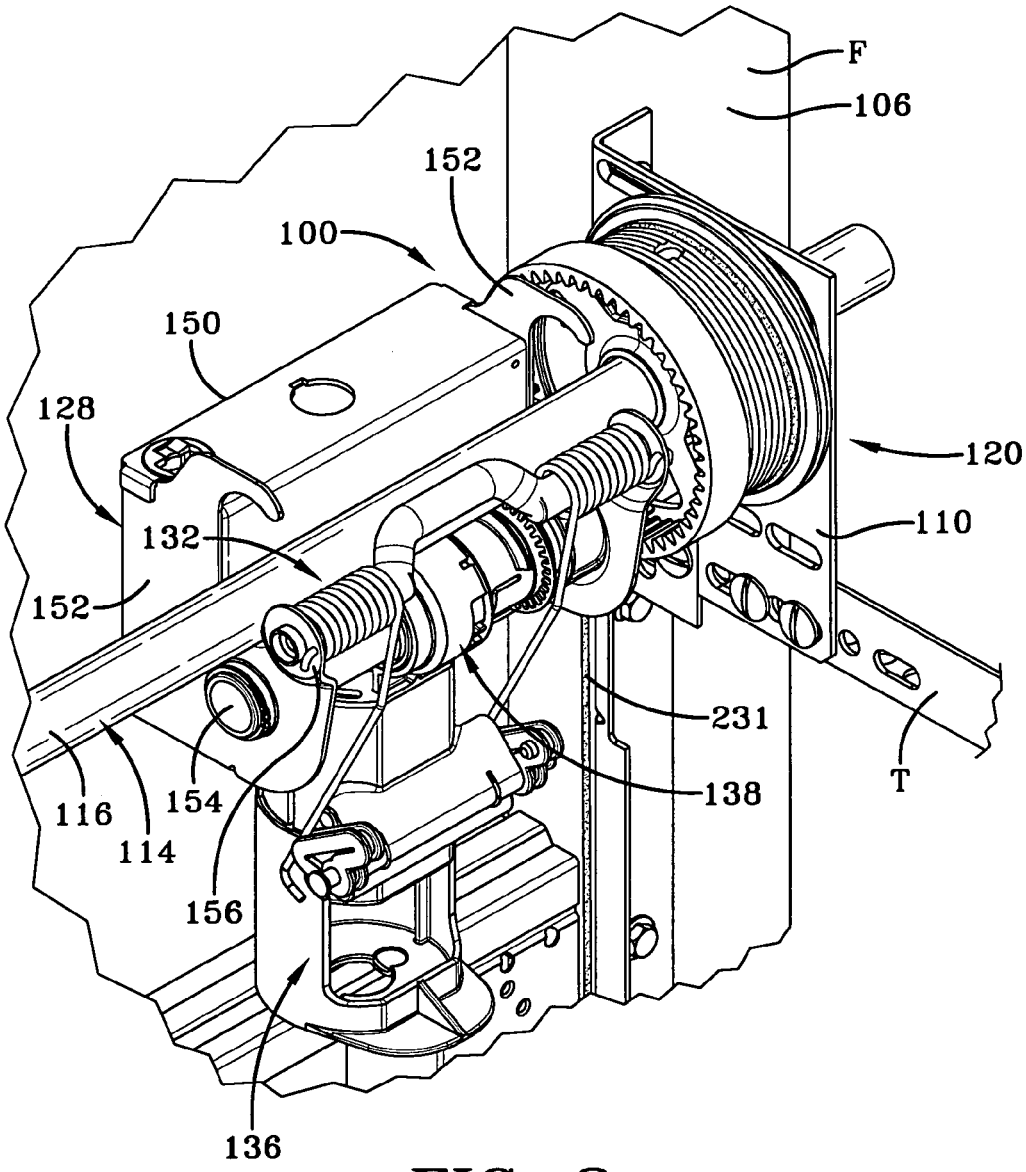
FIG. 2 is a perspective view of the motorized operator system shown in a locking position with a cover removed and associated with an integral cable storage drum and transfer assembly according to the concepts of the present invention.
Figure 2A:
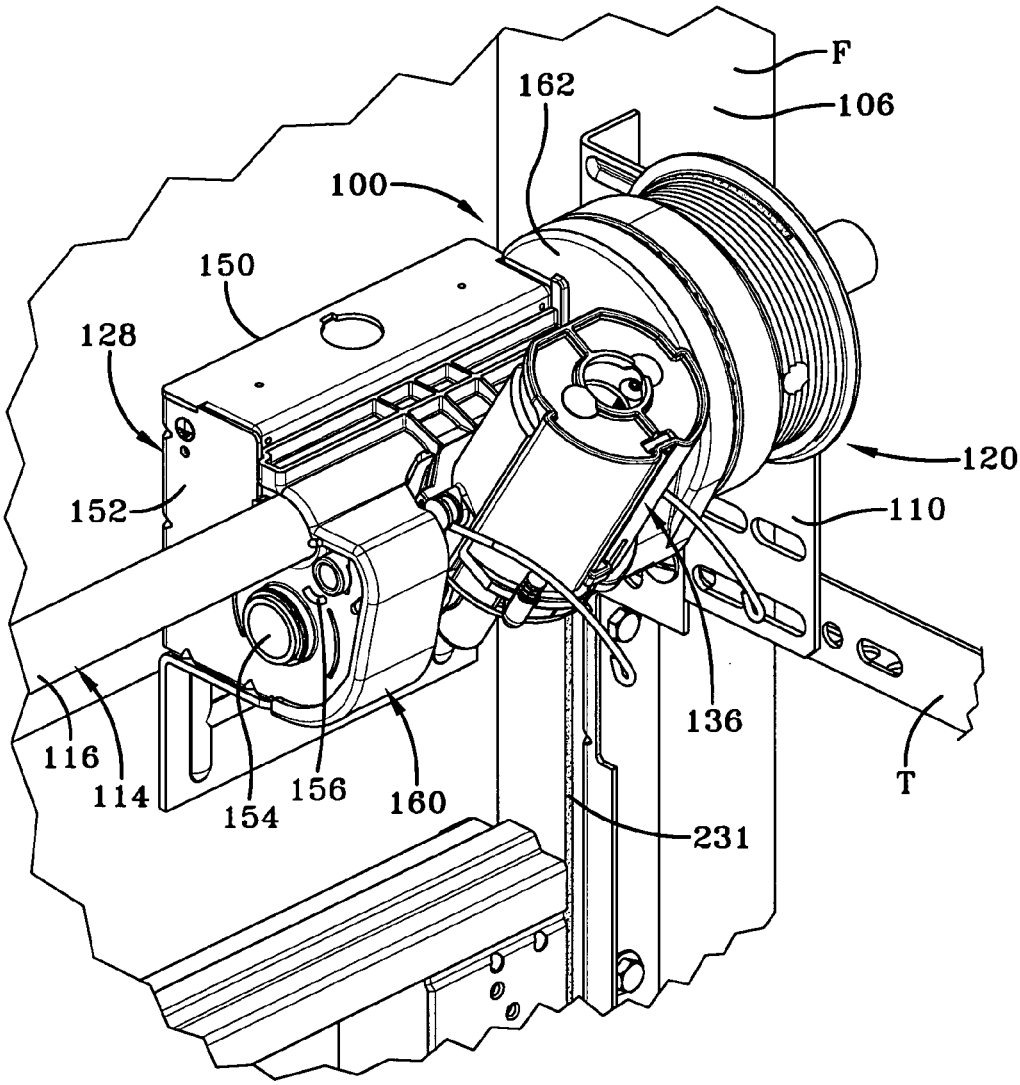
FIG. 2A is a perspective view of the motorized operator system, shown in an operating position with the cover installed and associated with the integral cable storage drum and transfer assembly according to the concepts of the present invention.

Referring now to FIGS. 1, 2, and 2A of the drawings, the operator system 100 mechanically interrelates with the door D through a counterbalance system generally indicated by the numeral 114. As shown, the counterbalance system 114 includes an elongated drive tube 116 having at one end a tensioning and cable drum assembly 118 positioned proximate one of the flag angles 110 away from the operator system. At an opposite end of the elongated drive tube 116 is another tensioning assembly specifically referred to herein as a cable storage drum and transfer assembly designated generally by the numeral 120 which is supported by a corresponding flag angle 110. It will be appreciated by persons skilled in the art that operator system 100 could be employed with a variety of torsion-spring counterbalance systems. The assemblies 118 and 120 each have a cable received thereabout which is affixed to the door D preferably proximate the bottom, such that rotation of the assemblies 120 operate to open or close the door D in conventional fashion. Details of the assembly 120 will be discussed after a review of other operator components.

The operator system 100 is used mostly when a new operator is to be used with most of an existing counterbalance system. The operator system 100 employs a header bracket 128 which includes a header portion 150 from which extends a pair of header flanges 152. Each flange has an aperture 154, and a slot 156. A support bracket may be provided to support the components of the operator system and the header bracket 128. The major components of the operator system 100 include a bias assembly 132, a motor assembly 136, and a drive assembly 138. The specific details of operation of the operator system 100 can be found in the aforementioned '138 application. Briefly, however, it will be appreciated that the motor assembly 136 is pivotally supported by the bias assembly 132. Both are carried by the header bracket 128. In particular, the bias assembly 132 is at least partially carried by the slots 156, and the drive assembly is rotatably received in the apertures 154. A cover 160, shown installed in FIG. 2A, is detachably secured to the header flanges 152 and has an end 162 configured to match the shape of an end of the cable storage drum and transfer assembly 120. The end 162 does not touch or interfere with movement or rotation of the assembly 120, but is proximally positioned so as to prevent entry of foreign objects that might otherwise interfere with operation of the system 100 and/or the assembly 120.

In FIG. 2, the motor assembly 136 is shown in a locking position with the door closed. When the motor assembly 136 is energized, it pivots upwardly away from the top section of the door, as best seen in FIG. 2A. Next, a shaft driven by the motor assembly rotates and engages the drive assembly 138, which in turn engages the cable storage drum and transfer assembly 120. This in turn rotates the counter-balance tube 116 and the corresponding assembly 118. One feature of the bias assembly 132 is that when an obstruction force is detected by the moving door, the bias force is overcome and causes the motor assembly to pivot downwardly which is detected by the operator system 100. This partial pivoting of the motor assembly initiates corrective action so that the door is at least stopped or stopped and reversed.

Figure 3:
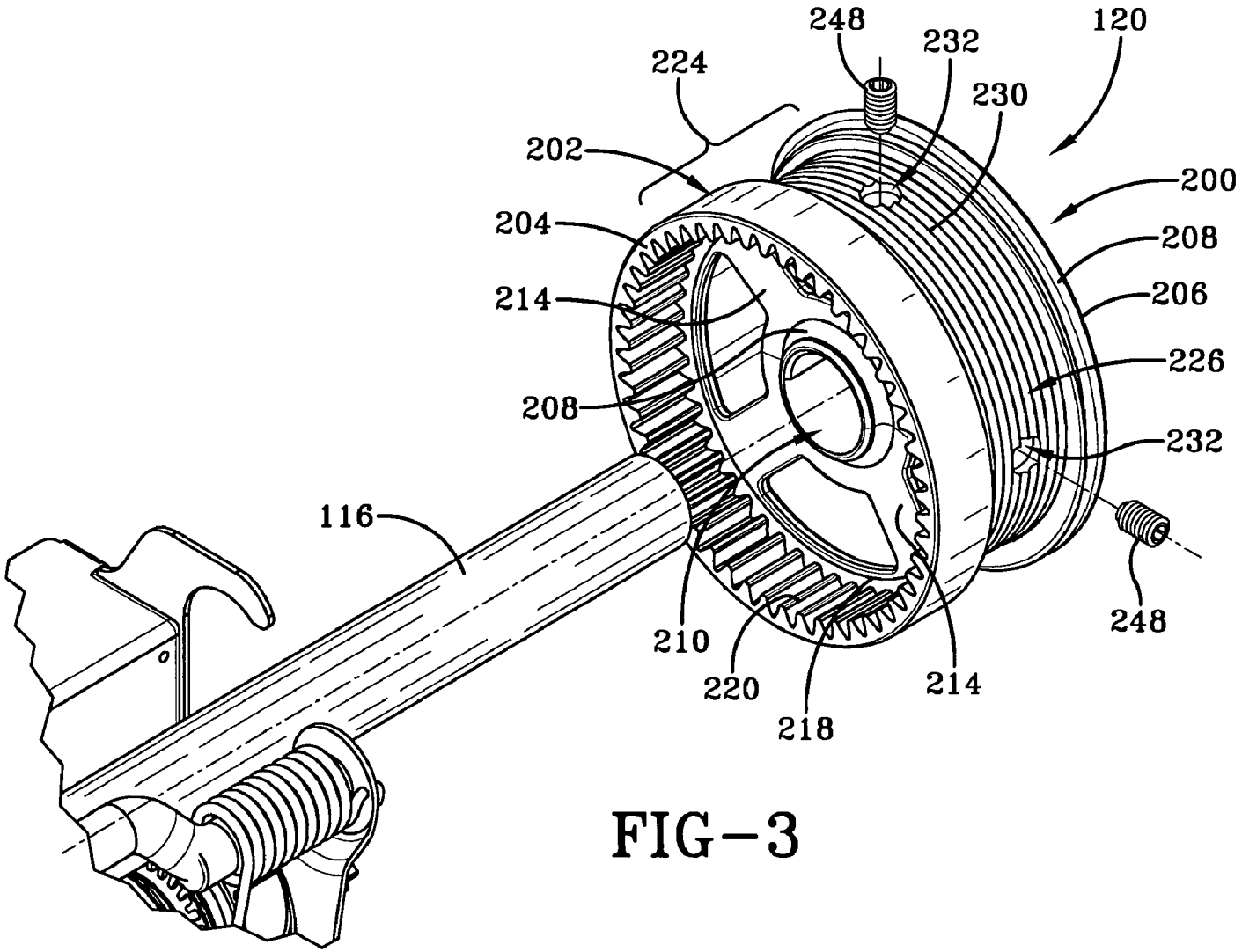
FIG. 3 is a left side exploded perspective view of the drum and transfer assembly of the present invention.
Figure 4:
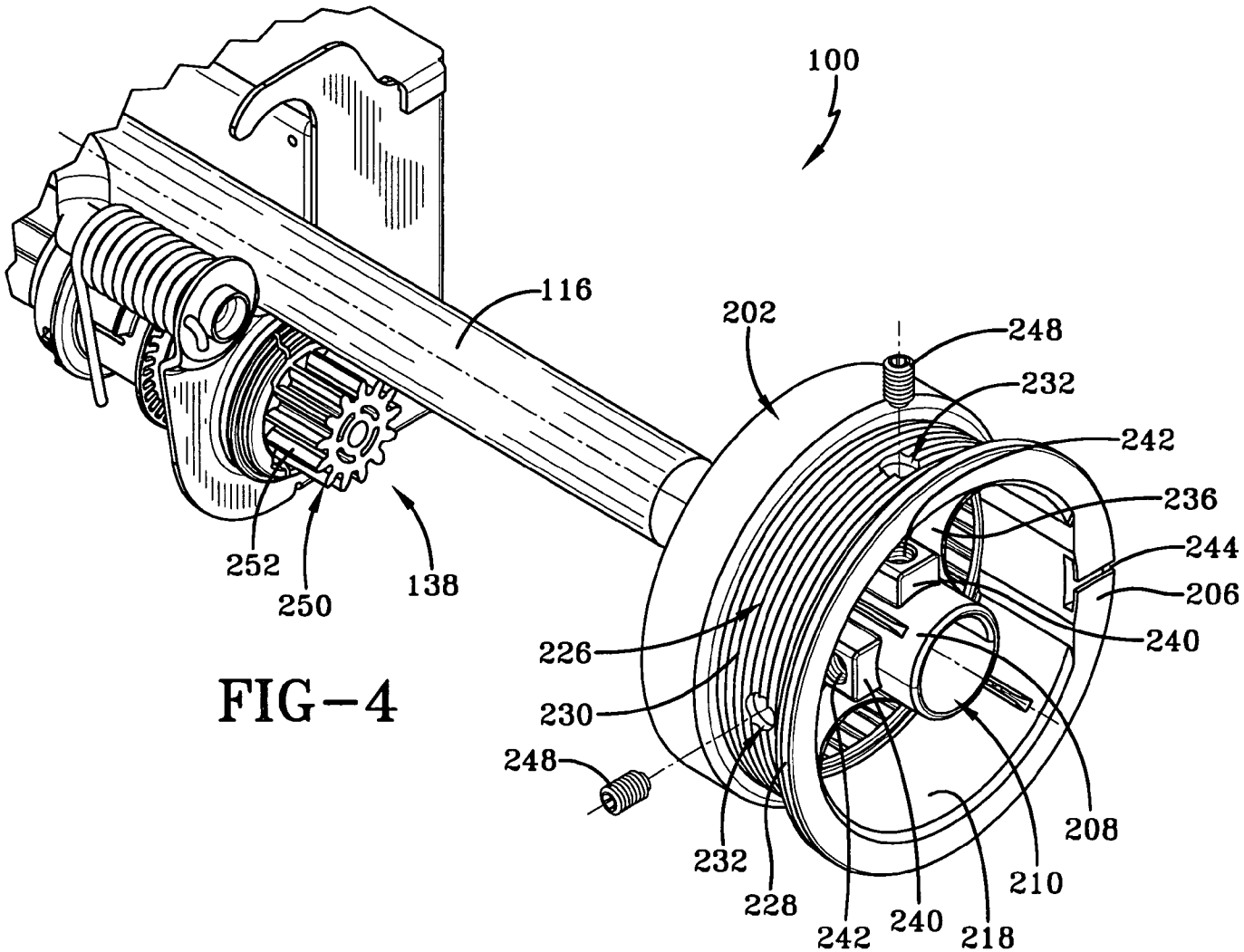
FIG. 4 is a right side exploded perspective view of the drum and transfer assembly of the present invention.
Figure 5:
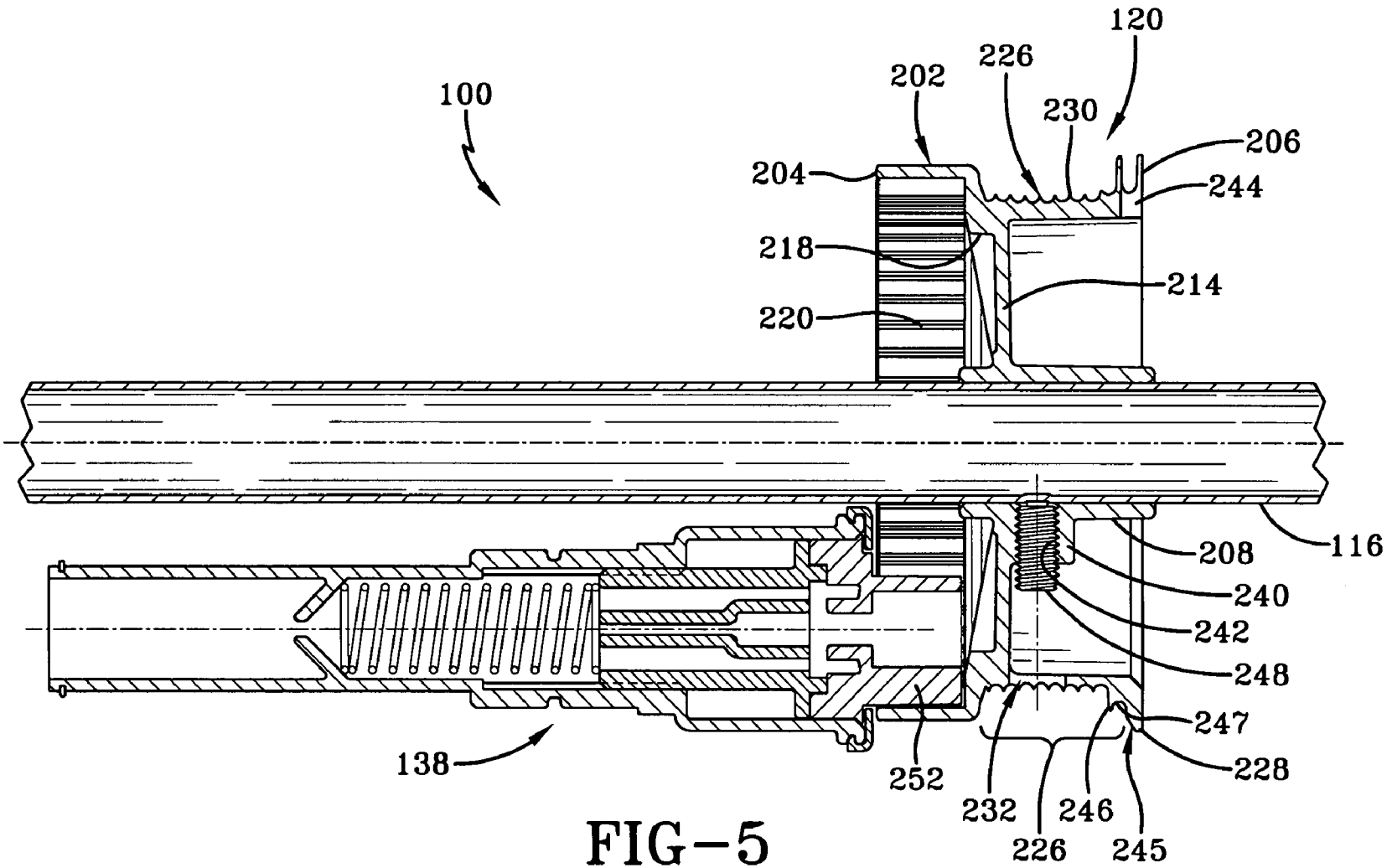
FIG. 5 is a cross-sectional view of the operator system with the drum and transfer assembly.

As best seen in FIGS. 3-5, it can be seen that the cable storage drum and transfer assembly is designated generally by the numeral 120. The assembly 120 includes a body 200 which provides an outwardly extending surface referred to herein as a rim 202. The rim 202 provides a gear side 204 opposite a cable side 206. Centrally located within the rim 202 is a hub 208 which is axially disposed and which provides a tube aperture 210 extending therethrough. The tube aperture 210 is sized so as to be slidably received on the counterbalance tube 116. At least one and ideally a plurality of spokes 214 extend radially from the hub 208 to the rim 202. Although four spokes are typically provided, it will be appreciated that the spokes could be of a unitary configuration or any multiple number appropriate to provide the necessary strength to the assembly 120.

The rim 202 provides a rim internal surface 218 from which radially extends inwardly a plurality of rim teeth 220. With appropriate modifications to the operator system, the rim teeth 220 could extend radially outward from the rim 202. In any event, opposite the rim internal surface 218 is a rim external surface 224. A portion of the external surface 224 is designated as a cable storage area 226 which is provided on a side of the body 200 away from the rim teeth 220. However, it will be appreciated that the cable storage area 226 could be provided on the entire external surface of the body 200. A cable lip 228 extends radially from an end of cable storage area 226 adjacent the cable side 206. A plurality of cable grooves 230 are provided in the cable storage area 226 so as to retain at least one lift cable 231 in an organized fashion as the door to which the cables are attached is raised and lowered. Extending through the cable storage area 226 are a pair of cross apertures 232. As shown in the drawings, these cross apertures 232 are spaced about 90 degrees apart from one another. However, the cross apertures may be equally spaced from one another and it will be further appreciated that although two cross apertures are shown, there could be only one cross aperture or, if desired, more than two cross apertures.

Referring now specifically to FIG. 4, which primarily shows the cable side 206 of the assembly 120, it can be seen that the rim internal surface 218 provides a plurality of ribs 236 extending toward and attached to the hub 208. The ribs 236 may be aligned or integral with the spokes which are best seen in FIG. 3, however such alignment is not required. A boss 240 extends from the hub and is aligned with each respective cross aperture 232. Specifically, each boss 240 provides internal threads 242 which are aligned with the cross apertures and extend all the way through the hub 208. A cable notch 244 is provided in the cable lip 228 along the cable side 206. It will be appreciated that an end of the lift cable not attached to the upper or lower section of the door is received and secured within the cable notch 244 so as to facilitate raising and lowering of the door. A transition channel 245 is provided proximal the cable side 206 so as to allow the lift cable 231 to transition from the cable notch 244 to the cable grooves 230. The channel 245 includes a channel wall 246 that together with the cable lip 228 forms a transition groove 247 which receives the cable 231. The channel wall 246 changes in radial height from the notch 244 to the grooves 230. This ensures retention of the cable as the assembly 120 is rotated.

The assembly 120 is slidably received on to the counterbalance tube 116 and positioned in a desired location so as to be properly aligned with the flag angle 110. Once properly positioned, and before installing the lift cable to the assembly 120, the installer inserts fasteners 248, which are preferably in the form of set screws, through the cross apertures 232 and into the internal threads 242. These fasteners are appropriately tightened such that rotation of the counterbalance tube 116 results in a corresponding rotation of the assembly 120. Although threaded fasteners 248 are shown in the drawing, those skilled in the art will appreciate that other types of fastening mechanisms could be employed to secure the assembly 120 to the counterbalance tube 116. The cross apertures 232 allow for the fasteners to be installed substantially perpendicularly with respect to the counterbalance tube 116. This allows for a more secure attachment of the assembly 120 to the tube 116. Indeed, such a configuration reduces the amount of stress imparted to the assembly 120 and, as such, reduces cracking thereof normally encountered during installation.

Once the assembly 120 is properly positioned on the counterbalance tube 116, the operator system is positioned and aligned such that the drive assembly 138 is engageable with the assembly 120. In particular, the drive assembly 138 includes a drive gear 250 with drive gear teeth 252 which mesh with and engage the rim teeth 220. As more fully described in the '138 application, the drive gear 250 is axially movable so as to engage and disengage the assembly 120. As best seen in FIG. 5, the drive gear teeth 252 are shown in the engaged position. Accordingly, as the motor assembly initiates movement of the drive gear assembly 138, the body 200 rotates in a corresponding fashion. As the body rotates, the counterbalance tube 116 rotates so as to reel in or pay out the lift cables so as to raise or lower the door.

The advantages of the present configuration are readily apparent to those skilled in the art. In particular, the present construction provides for ease of installation by providing apertures through the cable storage drum area which allows for insertion and servicing of the set screws in the received threaded areas. Moreover, the cable storage area is mostly empty when the lift cable is payed out and the barrier or door is in a closed position to allow for such access. Still other advantages of the present invention are provided inasmuch as the assembly 120 eliminates the need for multiple parts to provide the driven gear and cable storage functions. The assembly also allows for installation of set screws to be substantially perpendicular to the drive shaft so as to prevent cracking of the assembly 120. Another advantage is that the drive gear and the driven gear are allowed to rotate in the same direction. Yet another advantage of the present invention is that no additional room is required for the drive gear and the drive gear fits within the boundaries defined by the driven gear. As such, less room is required along the drive shaft and both the driven gear and the cable storage drum now require only one attachment point. Still other advantages are realized since there are less parts so as to reduce the cost of the overall assembly.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto and thereby. Accordingly, for an appreciation of the true scope and breadth of the invention, reference should be made to the following claims.

What is claimed is:

1. An operator system for moving a barrier between limit positions, comprising:

a counterbalance system including a counterbalance tube and at least one lift cable;

a pivoting operator motor assembly mounted proximate to, said counterbalance tube, at least a portion of said operator motor assembly movable depending upon an operating condition thereof;

a integral cable storage drum with a driven gear integrally formed thereon, both the drum and driven gear being mounted coaxially on said counterbalance tube and continuously connecting said pivoting operator motor assembly to said counterbalance tube, and a drive assembly which rotates a drive gear, wherein said driven gear is engageable with and rotated by said drive gear, thereby causing rotation of said counterbalance tube, wherein said at least one lift cable is secured at one end to said integral cable storage drum and driven gear and at an opposite end to the barrier, said cable storage drum further comprising a cable storage area that pays out or reels in said at least one lift cable as the barrier is moved.

2. The system according to claim 1, wherein said integral cable storage drum and driven gear is substantially horizontally aligned with said drive gear, such that rotation of said drive gear in one direction causes rotation of said counterbalance tube in the same direction.

3. The system according to claim 1, wherein said integral cable storage drum and driven gear further comprises:

an integral hub from which extends said driven gear and said cable storage area, said hub having a tube aperture therethrough that slidably receives said counterbalance tube;

at least one boss extending from said hub, said boss having a hub aperture extending therethrough to receive a fastener to secure said integral cable storage drum and driven gear to said counterbalance tube.

4. The system according to claim 1, wherein said integral hub aperture is substantially perpendicularly aligned with respect to said counterbalance tube.

5. The system according to claim 1, wherein said integral cable storage drum and driven gear further comprises:

at least one rib extending between said hub and said cable storage area, such that said cable storage area is radially spaced apart from said hub, said cable storage area having at least one cross aperture therethrough that is substantially aligned with said hub aperture, wherein said fastener is receivable through said cross aperture and received into said hub aperture.

* * * * *

UNITED STATES PATENT AND TRADEMARK OFFICE

CERTIFICATE OF CORRECTION

PATENT NO. : 7,717,155 B2
APPLICATION NO. : 11/375837
DATED : May 18, 2010
INVENTOR(S) : Willis J. Mullet It is certified that error appears in the above-identified patent and that said Letters Patent is hereby corrected as shown below:

Column 6, line 55 (Claim 1) the words “proximate to,” should read --proximate to--;
Column 6, line 59 (Claim 1) the words “a integral cable” should read --a cable--;
Column 8, line 5 (Claim 4) the words “claim 1” should read --claim 3--; and
Column 8, line 8 (Claim 5) the words “claim 1” should read --claim 3--.

Signed and Sealed this
Seventh Day of August, 2012

David J. Kappos

David J. Kappos
*Director of the United States Patent and Trademark Office*